US006041507A

United States Patent [19]

Dutcher et al.

[11] Patent Number: 6,041,507

[45] Date of Patent: Mar. 28, 2000

[54] MULTIPLE LINE DRAWING AID

[76] Inventors: David S. Dutcher; Jennifer B. Dutcher, both of 43 Quay Ct., #24, Sacramento, Calif. 95831

[21] Appl. No.: 08/995,573

[22] Filed: Dec. 22, 1997

[51] Int. Cl.[7] ..... B43L 13/02

[52] U.S. Cl. ..... 33/41.4; 401/35

[58] Field of Search ..... 15/435, 444; 33/19.2, 33/41.1, 41.4, 42; 434/85, 408, 415, 418; 401/34, 35

[56] References Cited

U.S. PATENT DOCUMENTS

| | | | |
|---|---|---|---|
| 235,656 | 12/1880 | Sprague | 15/435 |
| 883,009 | 3/1908 | Gee | 33/41.4 |
| 976,687 | 11/1910 | Pickwick, Jr. | 33/41.4 |
| 1,841,972 | 1/1932 | Mosley | 33/42 |
| 2,861,343 | 11/1958 | Click | 33/41 |
| 4,008,522 | 2/1977 | Anderson | 33/44 |
| 4,455,750 | 6/1984 | Sturz | 33/43 |
| 5,116,153 | 5/1992 | Tully | 401/35 |

FOREIGN PATENT DOCUMENTS

| | | | |
|---|---|---|---|
| 358758 | 9/1922 | Germany | 33/41.4 |

OTHER PUBLICATIONS

Photocopy of catalog item for Holding Multiple Pieces of Chalk, Date Unknown.

*Primary Examiner*—G. Bradley Bennett
*Attorney, Agent, or Firm*—Dennis W. Beech

[57] ABSTRACT

The multiple line drawing aid is a generally U-shaped device or channel which has holes in one side member and a tension friction plate attached to the holding member opposite. The tension friction plate has slots on the edge which are located to correspond to the holes in the aperture member. A drawing instrument such as a dry erase marker is then inserted in each hole and pushed into the structure formed by the friction plate and face plate to retain the marker. The holes and slots then serve to hold the inserted markers when the users moves them across a drawing surface to draw parallel lines.

4 Claims, 1 Drawing Sheet

MULTIPLE LINE DRAWING AID

BACKGROUND OF THE INVENTION

1. Field of the Invention

This invention relates to devices used to draw or write multiple lines on paper, display boards and the like. The present invention provides a simple holder to retain multiple drawing pens, pencils and other instruments for use in drawing parallel lines on the selected drawing medium.

2. Description of Related Art

There are various devices currently used for drawing parallel lines with the most commonly known being the aids used by draftspersons. Many plastic templets exist which have apertures formed therein for use in inserting the drawing point of a pen or pencil which device must be held by user. When the templet is moved along a straight edge a straight line is drawn by the inserted point of the writing instrument. By moving the writing instrument to a different aperture, a line may be drawn parallel to the first line. This process may of course be repeated many times.

If it is desired to draw or display parallel lines on a presentation medium, such as, chalk board, dry erase board or the like, the drawing of one line at a time is much more difficult. Some presenters may use an overhead projector with a view foil already lined to demonstrate their material. However, this does not allow the advantage of being able to stand at the presentation board to discuss and demonstrate presentation material.

Other devices for drawing lines on a presentation board include a wood and wire device, designed to hold chalk in the formed wire, which has been used by music teachers to draw music staff lines on chalk boards. A more complicated writing instrument holding device is disclosed in U.S. Pat. No. 5,116,153. Neither of these devices provides a simple, sturdy holding device for a variety of drawing instruments.

The present invention is preferably a holder formed from a single piece of material as for example plastic. The aid is shaped as a channel or generally U-shaped device with apertures in one side member and a tension friction plate formed in the opposite side member. Pens, pencils or other drawing instruments are placed through the apertures and into the structure formed by the tension friction plate. The pens are then retained by the friction or spring force of the tension friction plate. With multiple pens inserted the drawing aid may be held in the hand and the multiple pen tips moved across a writing surface to create parallel lines. This writing instrument holding structure allows simple insertion and removal of writing instruments; is sturdy and durable in structure; allows ease of use with one hand; and may be stored with pens installed and ready to use.

SUMMARY OF THE INVENTION

One object of the present invention is provision for retaining multiple drawing instruments in a drawing aid to facilitate drawing of multiple parallel lines. Another object is to allow storage of the drawing aid with drawing instruments installed.

In accordance with the description presented herein, other objectives of this invention will become apparent when the description and drawings are reviewed.

DESCRIPTION OF THE PREFERRED EMBODIMENT

Figure 1:
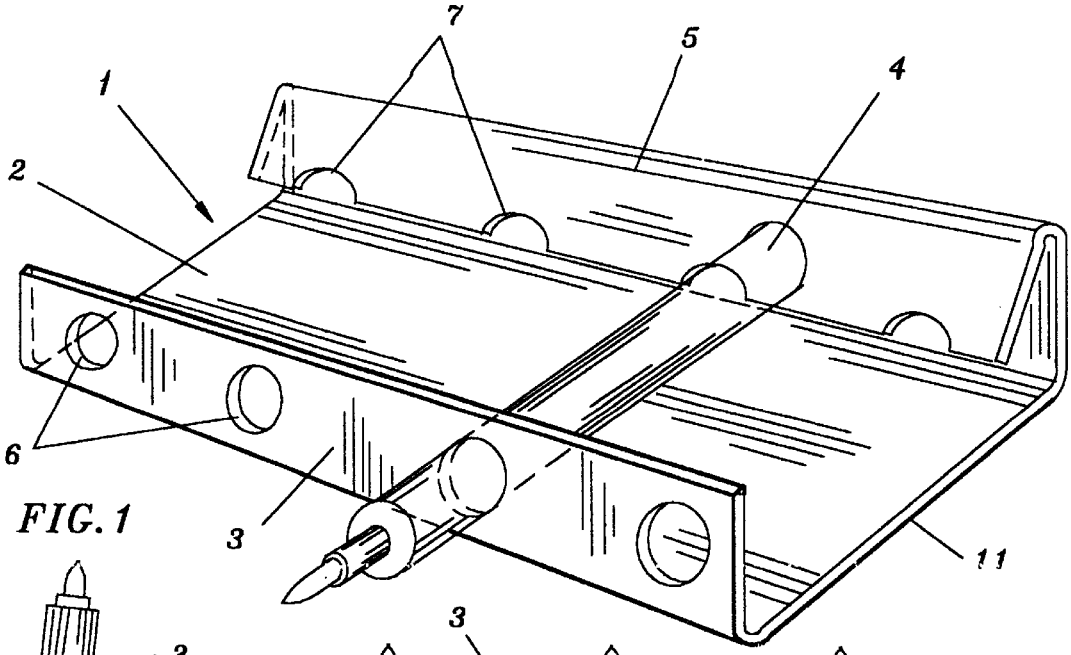
FIG. 1 illustrates a perspective view of the drawing aid.

The multiple line drawing aid is a generally U-shaped device or channel which has a tension friction plate to retain drawing instruments inserted into the drawing aid. The aperture member opposite the friction plate holds the drawing instrument in position as the drawing aid is moved across a drawing or writing surface to produce parallel lines.

Referring to FIGS. 1 through 4, the multiple line drawing aid (1) is a generally U-shaped device or channel having a face plate (2) with an aperture member (3) opposite a holding member (4) along the longitudinal dimension. The holding member (4) has a tension friction plate (5) at an angle of less than 90 degrees from the holding member (4) and is inclined toward the face plate (2).

The aperture member (3) has multiple apertures (6) spaced apart to provide the desired distance between the parallel lines to be drawn on a drawing or writing surface. The tension friction plate (5) has slots (7) formed therein opposite the apertures (6) such that when a drawing instrument (8) is inserted through an aperture (6) it engages a corresponding slot (7). The drawing instrument (8) is then pressed into the structure formed by the tension friction plate (5) and the face plate (2) as illustrated in FIG. 2 which forms a double tension clip between the aperture member (3) and tension friction plate (5).

Figure 3:
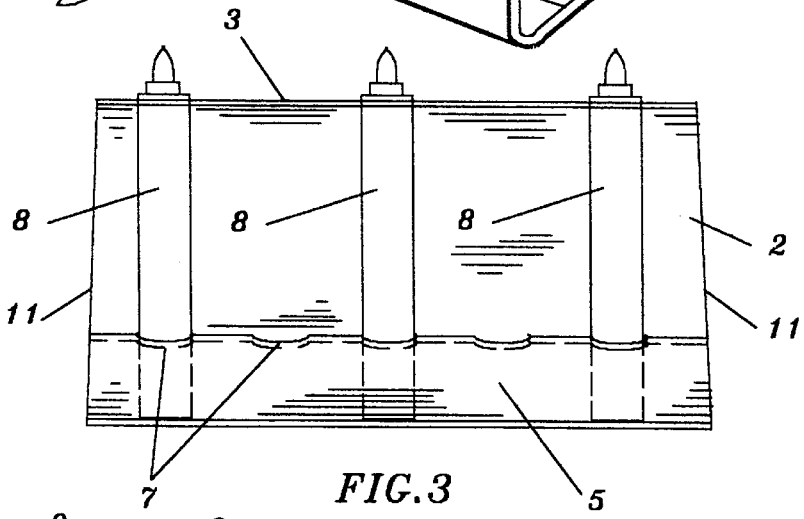
FIG. 3 illustrates a front elevation view of the drawing aid with drawing instruments.
Figure 4:
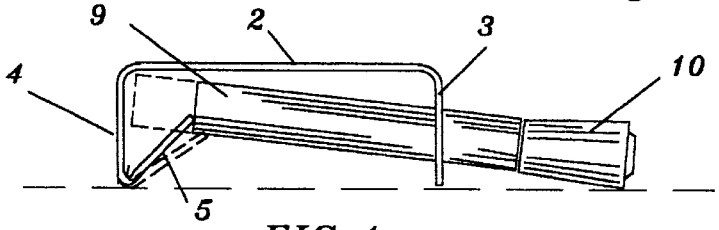
FIG. 4 illustrates a side view of the drawing aid with dry erase markers installed.

With multiple drawing instruments (8) inserted in the drawing aid (1), as illustrated in FIG. 3, the drawing aid (1) may be held in one hand and the drawing instruments (8) moved across a drawing surface to create multiple parallel lines. The drawing aid (1) may be stored with dry erase markers (9) installed as illustrated in FIG. 4. As can be seen, the dry erase markers (9) in this stored position are generally horizontal with a slight incline downward from the base to the tip end (10). This provides for flow of ink to the tip end (10) of the marker (9). For those situations where the user has limited space for storage, the drawing aid (1) can have edges (11) tapered as illustrated in FIG. 3. Thus for example, if the drawing aid (1) is set on an edge (11) the drawing instruments (8) will again be incline downward from base to tip end (10). This is a good configuration for storage on a wall board tray.

While the preferred embodiment has been illustrated with five positions for drawing instruments (8) it is obvious more or less positions may be provided in a particular drawing aid (1). The tension friction plate (5) and face plate (2) form a structure which in combination with the aperture member (3) retains an inserted drawing instrument (8) due to the friction forces of the engaged surfaces and a spring force of the tension friction plate (5) and face plate (2) when constructed of a resilient or elastic material.

Figure 2:
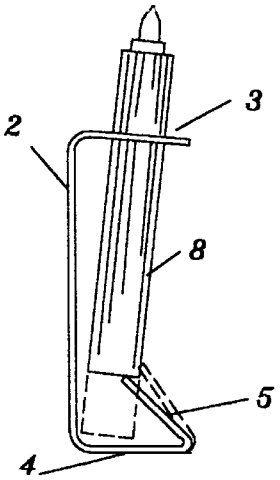
FIG. 2 illustrates a side elevation view of the drawing aid with drawing instrument inserted.

The aperture member (3) may be generally perpendicular to the face plate (2) as illustrated in FIG. 4 or it may be attached at an angle less than 90 degrees as illustrated in FIG. 2. In the first instance the apertures (6) must be sized to allow the drawing instruments (8) to be forced into slots (7). In the second embodiment the apertures (6) may be sized such that they tend to guide the drawing instruments (8) toward the face plate (2) as they are pushed into the drawing aid (1). Of course the apertures (6) and slots (7) are sized to fit the particular drawing instruments (8) to be used.

It has been found that constriction of the drawing aid (10) from a single piece of clear plastic elastic sheet material formed to the proper shape gives good performance in retaining dry erase markers.

We claim:

1. A device for drawing multiple lines comprising:

a face plate having an aperture member opposite a holding member with a longitudinal axis forming a generally U-shaped channel;

the holding member having a tension friction plate attached along the longitudinal axis and inclined toward the face plate; and the aperture member having a plurality of apertures defined therein and the friction plate having a plurality of slots defined therein which correspond in location to the apertures for insertion and retaining a drawing instrument.

2. The device as in claim 1 wherein the apertures are located such that when the drawing aid is stored the drawing instruments are slightly inclined relative to horizontal.

3. The device as in claim 1 wherein an edge is tapered such that when the drawing aid is stored on the edge the drawing instruments are slightly inclined relative to horizontal.

4. The device as in claim 1 wherein the aperture member is attached to the face plate at an angle such that when the drawing instrument is inserted through the apertures the drawing instrument is guided toward the face plate.

* * * * *